US006501453B1

(12) United States Patent
Wong

(10) Patent No.: US 6,501,453 B1
(45) Date of Patent: Dec. 31, 2002

(54) DRIVING METHOD FOR A LIQUID-CRYSTAL-DISPLAY

(75) Inventor: Jia-Fam Wong, Taipei Hsien (TW)

(73) Assignee: Acer Display Technology Inc., Hsinchu (TW)

( * ) Notice: Subject to any disclaimer, the term of this patent is extended or adjusted under 35 U.S.C. 154(b) by 0 days.

(21) Appl. No.: 09/377,791

(22) Filed: Aug. 20, 1999

(30) Foreign Application Priority Data

Aug. 21, 1998 (TW) ..... 87113869 A

(51) Int. Cl.[7] ..... G09G 3/36

(52) U.S. Cl. ..... 345/90; 345/91; 345/92; 345/93; 345/94

(58) Field of Search ..... 345/90, 91, 92, 345/93, 94

(56) References Cited

U.S. PATENT DOCUMENTS 5,296,847 A 3/1994 Takeda et al.

*Primary Examiner*—Richard Hjerpe
*Assistant Examiner*—Jean Lesperance
(74) *Attorney, Agent, or Firm*—Ladas & Parry

(57) ABSTRACT

The present invention provides a driving method for a liquid-crystal-display (LCD) which is driven by a plurality of switching transistors positioned in a matrix. The drain of each switching transistor couples to a first scanning signal via a storage capacitor and to a pixel electrode. The gate and the source of each switching transistor respectively couples to a second scanning signal and a video signal. One step of the driving method is shifting the video signal to have a dc voltage of a first predetermined voltage. Another step of the driving method is adding a second predetermined voltage to the pixel electrode after the second scanning signal changes the state of the switching transistor from turned-on to turn-off

10 Claims, 10 Drawing Sheets

DRIVING METHOD FOR A LIQUID-CRYSTAL-DISPLAY

BACKGROUND OF THE INVENTION

1. Field of the Invention

The present invention generally relates to a driving method for a liquid-crystal-display (LCD), and more particularly, to a driving method utilizing a gate expiatory voltage and a capacitor coupling effect to drive the LCD by a thin-film-transistor (TFT) active matrix. The present invention can simplify gate pulse waveforms generated by a gate driving circuit, lessen the output voltage range generated by a video signal driving circuit and significantly reduce the difficulty and cost for circuit design.

2. Description of the Related Art

FIG. 1 is a driving circuit with a TFT active matrix disclosed in U.S. Pat. No. 5,296,847. The driving circuit with a TFT active matrix comprises a TFT matrix 10, a scanning channel driving circuit 11, a video channel driving circuit 12, and a constant voltage generating circuit 13. Each TFT in the TFT matrix 10 connects to a storage capacitor Cs to drive a relative LCD cell (shown as a loading capacitor $C_{lc}$). The scanning channel driving circuit 11 generates gate controlling signals Vg(N), Vg(N−1) . . . to drive the gates of the connected TFTs via scanning channels 11*a*, 11*b*. . . The video channel driving circuit 12 generates and sends video signals to the LCD cells via video signal channels 12*a*, 12*b*. . . and the TFTs. The constant voltage generating circuit 13 generates a constant voltage Vt as a reference voltage for all LCD cell $C_{lc}$.

FIG. 2 is an enlarged diagram of the area 10' in FIG. 1. In this prior art, the TFT is positioned at the intersection of the video signal channel 12*b* and the scanning channel 11*b*. Three parasitic capacitors of Cgd, Csd and Cgs are formed between gate/drain, source/drain and gate/source respectively. The gate of the TFT connects to a gate controlling signal Vg(N) for scanning, the source of the TFT connects to a video signal Vsig, and the drain of the TFT, a pixel electrode of a LCD cell, connects to a terminal of a storage capacitor Cs and a terminal of a LCD cell. The other terminal of the storage capacitor Cs connects to a preceding gate controlling signal Vg(N−1) in a preceding (first) scanning channel. The other terminal of the LCD cell Clc connects to a reference voltage Vt generated by the constant voltage generating circuit 13.

Please refer to FIG. 3A and FIG. 3B. FIG. 3A is a diagram of signal waveforms of the driving circuit in FIG. 1 operated at odd field (negative polarity period). FIG. 3B is a diagram of signal waveforms of the driving circuit in FIG. 1 operated at even field (positive polarity period).

As shown in FIG. 3A, while the driving circuit is operated at odd field, or the LCD cell is driven at negative polarity, the gate controlling signal Vg(N) is changed from a low voltage Vgl to a high voltage Vgh and is held for a time period Ts1 after the polarity of the video signal Vsig is changed from positive to negative. Then the gate controlling signal Vg(N) will be lowered to a negative expiatory voltage Ve(−) and be held for a time period Ts2. After the gate controlling signal Vg(N) is lowered to the negative expiatory voltage Ve(−), a gate controlling signal Vg(N+1) at a succeeding scanning channel is changed from a low voltage Vgl to a high voltage Vgh and is held for a time period Ts1. Then the gate controlling signal Vg(N+1) will be lowered to a positive expiatory voltage Ve(+) and be held for a time period Ts2. The time period Ts2 is longer than the time period Ts1 in this example. After the time period Ts2 of holding the voltage, the gate controlling signal Vg(N) in a scanning channel will be returned to the low voltage Vgl from the negative expiatory voltage Ve(−), and the gate controlling signal Vg(N+1) in a succeeding scanning channel will be returned to the low voltage Vgl from the positive expiatory voltage Ve(+).

Similarly, as shown in FIG. 3B, while the driving circuit is operated at even field, or the LCD cell is driven at positive polarity, the gate controlling signal Vg(N) is changed from a low voltage Vgl to a high voltage Vgh and is held for a time period Ts1 after the polarity of the video signal Vsig is changed from negative to positive. Then the gate controlling signal Vg(N) will be lowered to a positive expiatory voltage Ve(+) and be held for a time period Ts2. After the gate controlling signal Vg(N) is lowered to the positive expiatory voltage Ve(+), a gate controlling signal Vg(N+1) at a succeeding scanning channel is changed from the low voltage Vgl to the high voltage Vgh and is held for a time period Ts1. Then the gate controlling signal Vg(N+1) will be lowered to the negative expiatory voltage Ve(−) and be held for a time period Ts2. The time period Ts2 is longer than the time period Ts1 in this example, that is, the gate controlling signal Vg(N+1) accomplishes its scanning while the gate controlling signal Vg(N) is at the positive expiatory voltage Ve(+). After the time period Ts2, the gate controlling signal Vg(N) in a scanning channel will be returned to the voltage Vgl from the positive expiatory voltage Ve(+), and the gate controlling signal Vg(N+1) in a succeeding scanning channel will be returned to the voltage Vgl from the negative expiatory voltage Ve(−).

While the reference voltage Vt is constant, the driving method in FIG. 3A and FIG. 3B utilizes a 4-level gate signal combined with a C-coupled effect induced by parasitic capacitors and the storage capacitor to keep the voltage of the pixel electrode A of a LCD cell in the voltage range for positive driving or negative driving.

FIGS. 4A, 4B, 5A, and 5B show diagrams of signal waveforms of the driving circuit in FIG. 1. Although the output voltage range of the video signal Vsig can be constricted by the method utilizing a 4-level gate signal, the waveforms of the gate controlling signal Vg(N) and Vg(N+1) are very complicated.

FIG. 6 is a diagram of signal waveforms utilizing a 3-level gate signal of the driving circuit in FIG. 1. The waveforms of this driving method with 3-level gate signals are less complicated. However, this method is achieved by the enlargement of the output voltage range of the video signal Vsig. Thus, the cost of the video signal driving circuit 12 is higher.

SUMMARY OF THE INVENTION

Therefore, an object of the present invention is to provide a driving method for a liquid crystal display (LCD). The present invention utilizes the coupling effect of the parasitic capacitors and the storage capacitor to keep the voltage of the pixel electrode A of a LCD cell in the voltage range of positive driving or negative driving. Further, the waveforms of the gate controlling signals are simplified and the output voltage range of the video signal Vsig is constricted.

In the present invention, the LCD is driven by a plurality of switching transistors, such as TFTs, positioned in a matrix. Each switching transistor comprises a drain, a gate and a source. The drain of each switching transistor couples to a first scanning signal via a storage capacitor and to a pixel electrode. The gate and the source of each switching transistor respectively couple to a second scanning signal and a video signal. One step of the driving method of the present invention is shifting the video signal to have a dc voltage of a first predetermined voltage. Another step is adding a second predetermined voltage to the pixel electrode after the second scanning signal changes the state of the switching transistor from turned-on to turn-off.

The first predetermined voltage is equal to $$-V^*+[C_{gd}/C_t]\times V_g.$$

$V^*$ is the central driving voltage of the LCD. $C_{gd}$ is a gate-to-drain parasitic capacitance formed between the gate and the drain of each TFT. $C_t$ comprising $C_{gd}$ is a totally effective capacitance at the pixel electrode. Vg is the voltage pulse height at the second scanning signals.

The second predetermined voltage is equal to $2\times V^*$. A further equation exists between the second predetermined voltage and the capacitors; that is $$V_{ge}(-)\times C_s/C_t=2\times V^*.$$

$V_{ge}(-)$ is a negative gate expiatory voltage. $C_s$ is the capacitance of the storage capacitor. $C_t$ is a totally effective capacitance at the-pixel electrode. $V^*$ is the central driving voltage of the LCD.

Further features and advantages of the present invention, as well as the structure and operation of various embodiments of the present invention, are described in detail below with respect to the accompanying drawings. In the drawings, like reference numbers indicate identical or functionally similar elements.

DETAILED DESCRIPTION OF THE PREFERRED EMBODIMENTS

According to the driving method of the present invention, a LCD is driven by a plurality of switching transistors, such as TFTs, positioned in a matrix. Each switching transistor comprises a drain, a gate and a source. The drain of each switching transistor couples to a first scanning signal (i.e. the signal of the preceding scanning channel) via a storage capacitor and to a pixel electrode. The gate and the source of each switching transistor respectively couple to a second scanning signal (i.e. the signal of the current scanning channel) and a video signal. The video signal is shifted with a first predetermined voltage to compensate a voltage induced by feed-through effect. Thus, the time-average voltage (dc voltage) of the video signal is equal to the first predetermined voltage. While a LCD cell is driven at positive polarity, the first scanning signal turns on a switching transistor for a period of time while the video signal is at a high voltage to charge the storage capacitor and the connected LCD cell to the high voltage. Then the second scanning signal in the succeeding channel returns to a low gate voltage from a negative gate expiatory voltage. The second scanning signal induces a coupling voltage to the pixel electrode to shift the voltage of the pixel electrode in the voltage range of positive polarity. While a LCD cell is driven by a negative polarity, the first scanning signal turns on a switching transistor for a period of time while the video signal is at a low voltage to charge the storage capacitor and the connected LCD cell to the low voltage.

Figure 2:
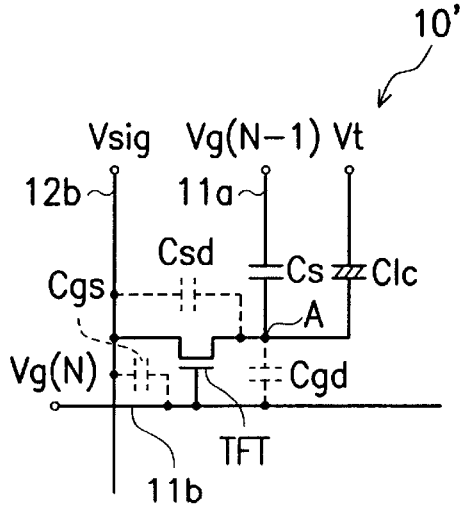
FIG. 2 is an enlarged diagram of the area 10' in FIG. 1.
Figure 3A:
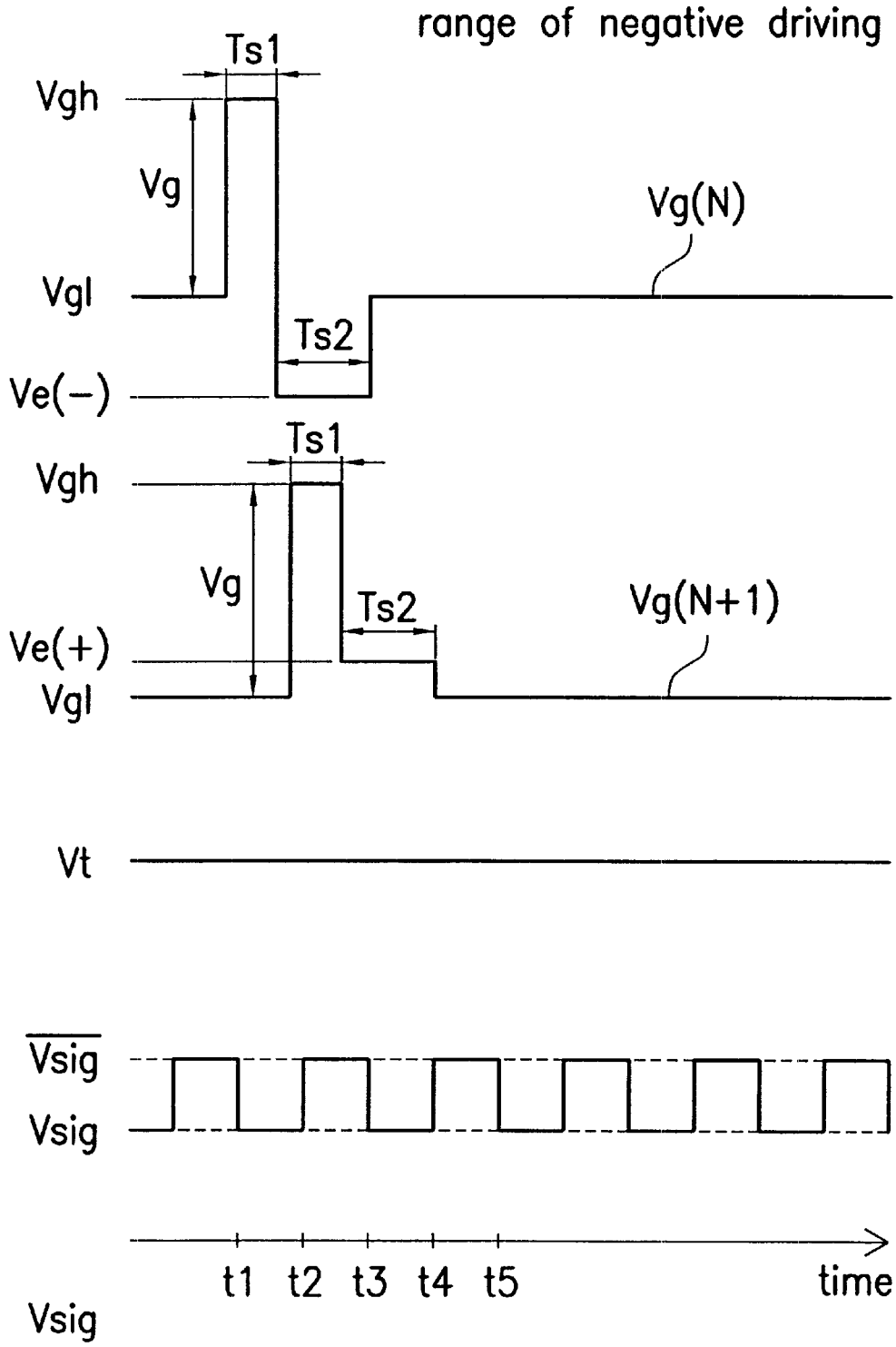
FIG. 3A is a diagram of signal waveforms of the driving circuit in FIG. 1 operated at odd field.
Figure 3B:
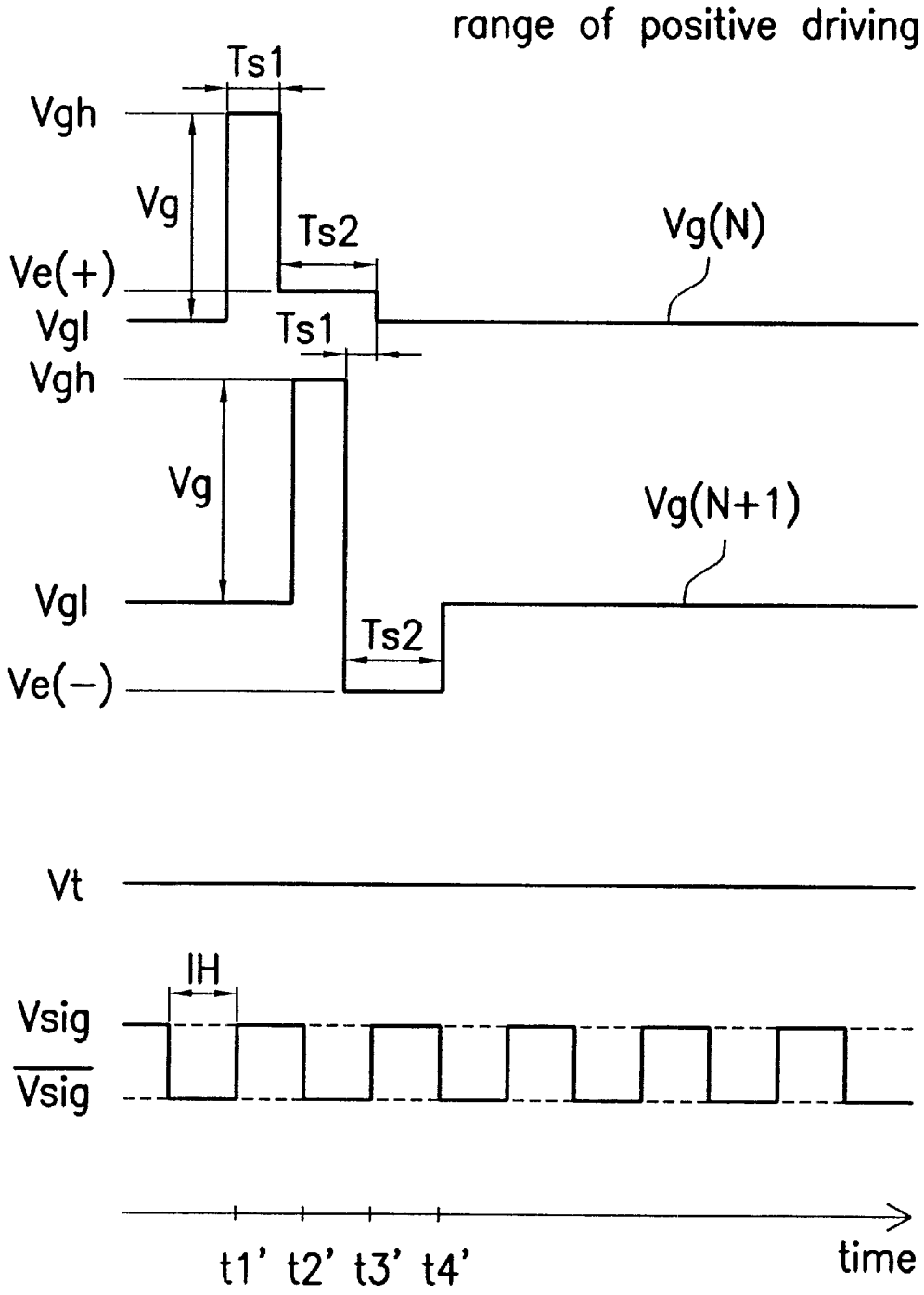
FIG. 3B is a diagram of signal waveforms of the driving circuit in FIG. 1 operated at even field.
Figure 4A:
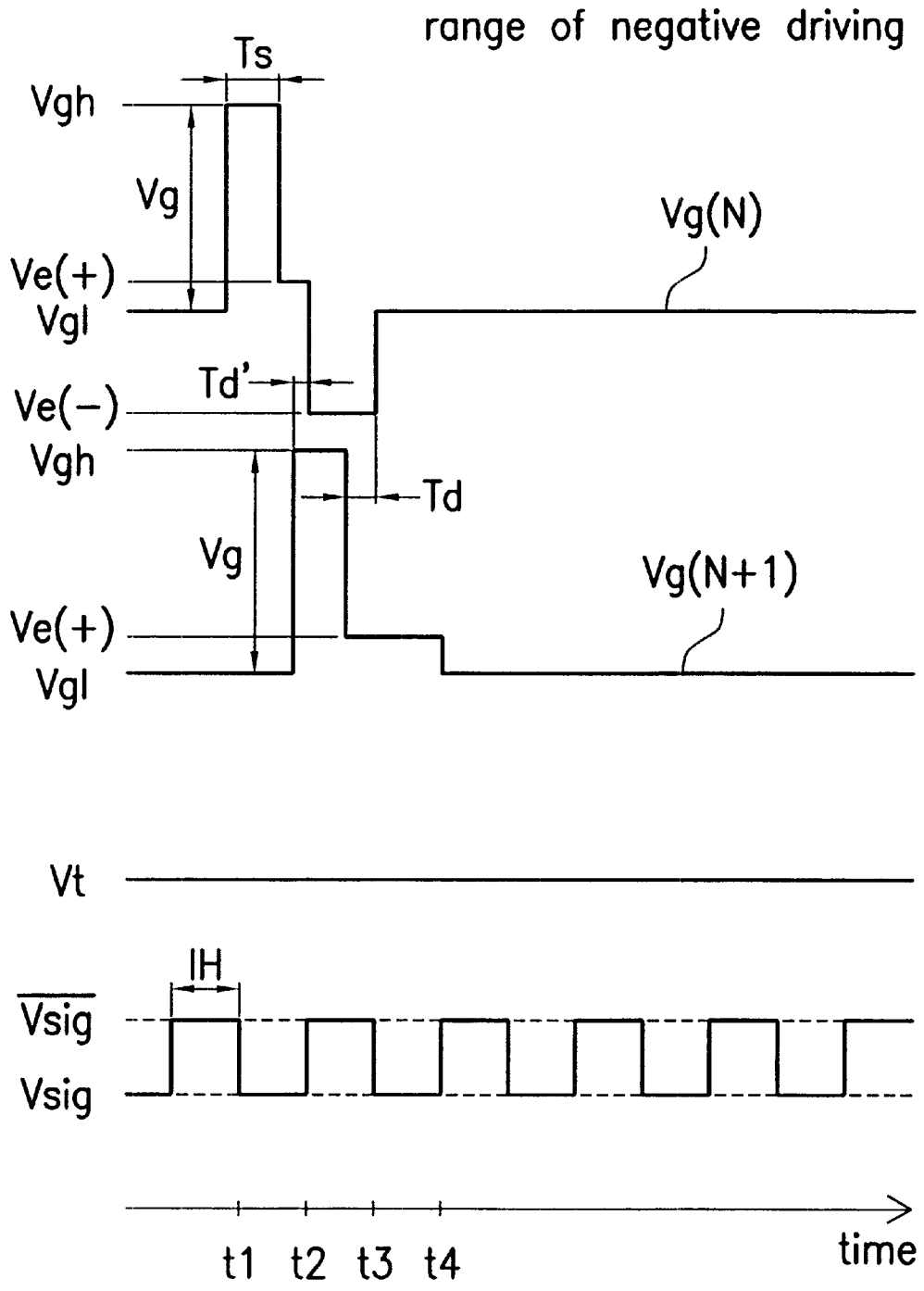
FIG. 4A is another diagram of signal waveforms of the driving circuit in FIG. 1 operated at odd field.
Figure 4B:
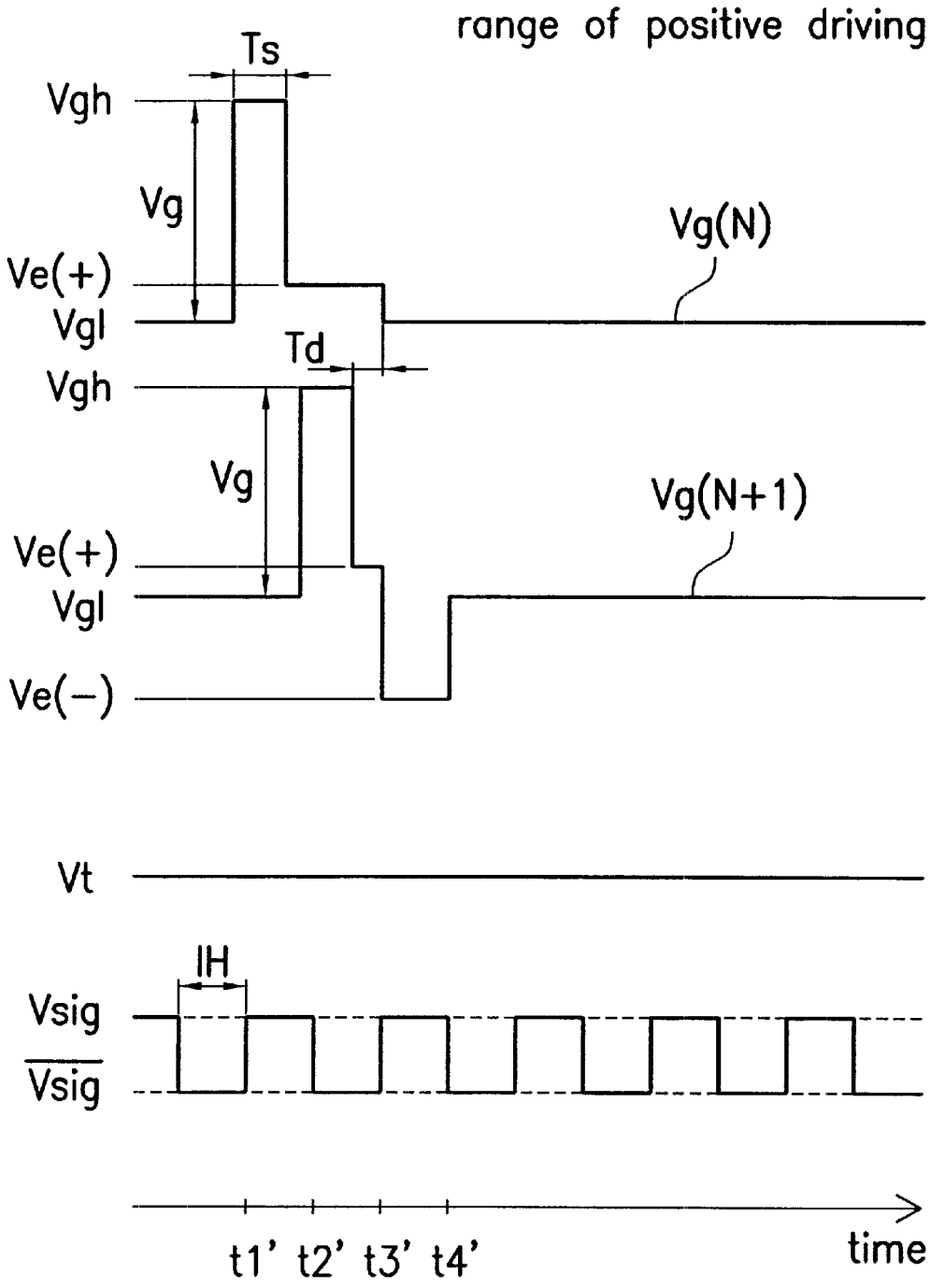
FIG. 4B is another diagram of signal waveforms of the driving circuit in FIG. 1 operated at even field.
Figure 5A:
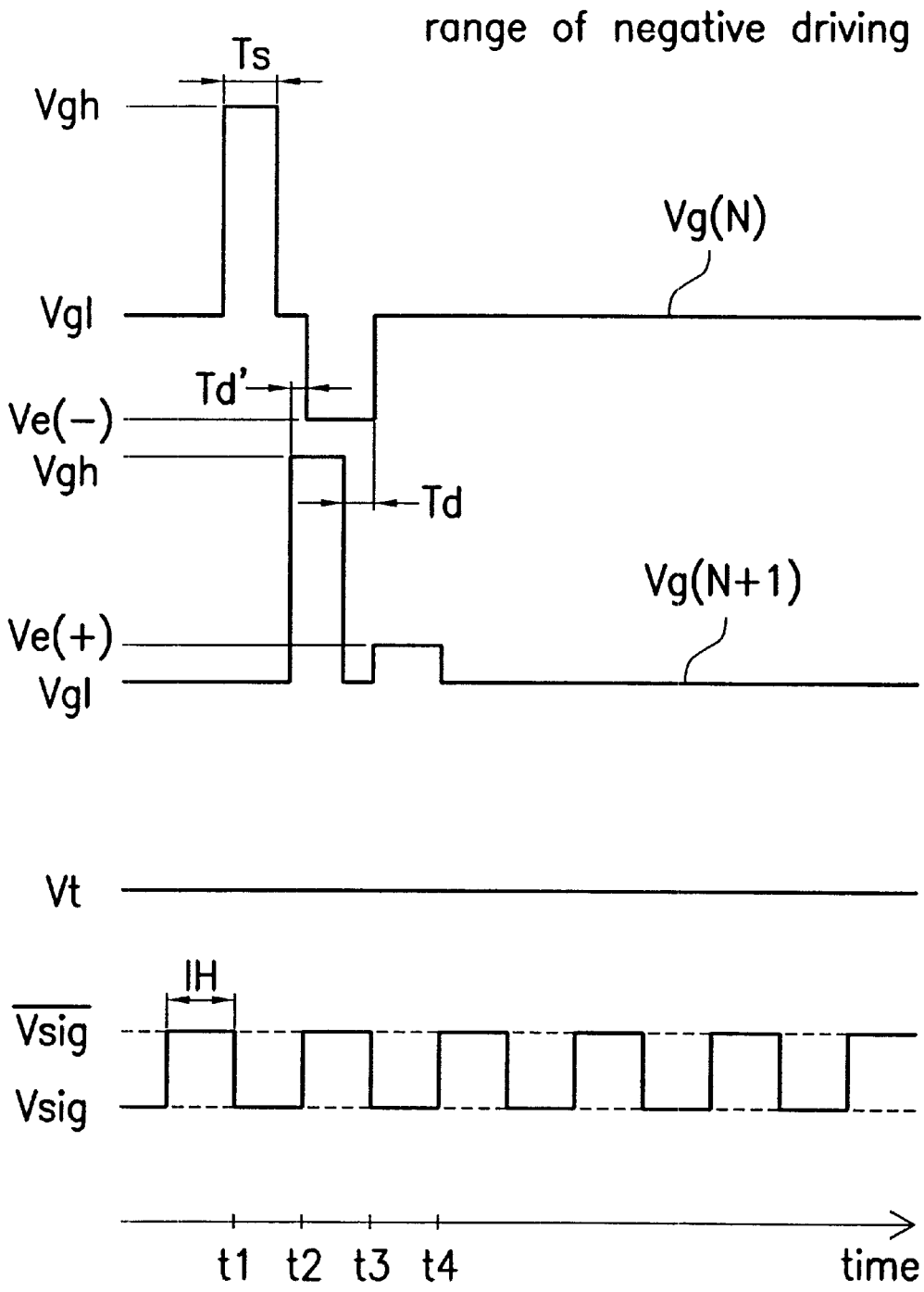
FIG. 5A is a further diagram of signal waveforms of the driving circuit in FIG. 1 operated at odd field.
Figure 5B:
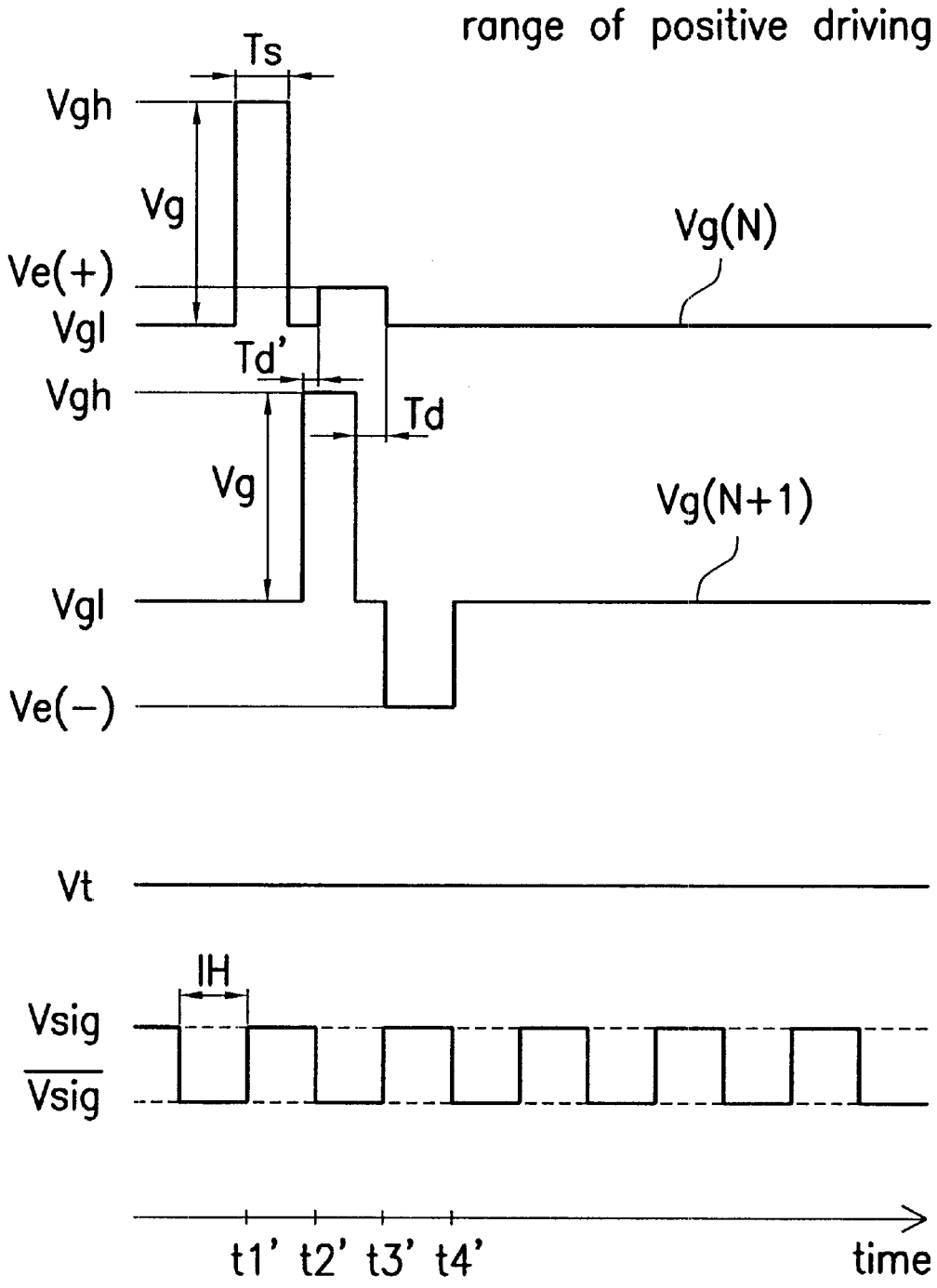
FIG. 5B is a further diagram of signal waveforms of the driving circuit in FIG. 1 operated at even field.
Figure 6:
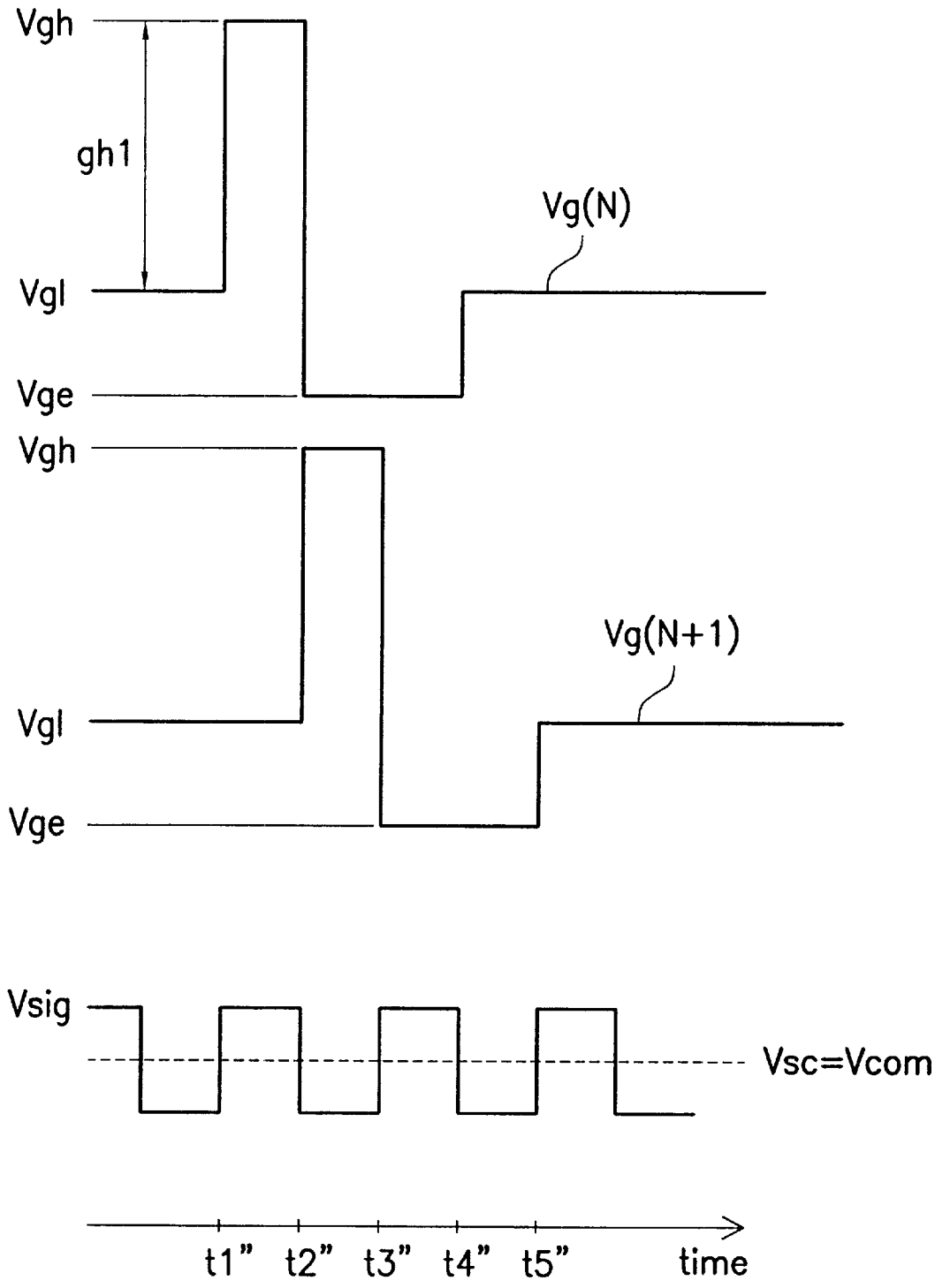
FIG. 6 is a diagram of signal waveforms utilized a 3-level gate signal of the driving circuit in FIG. 1.

The detail operations according to the present invention are now described; similarly, as shown in FIG. 2, wherein the capacitance of the storage capacitor connected to the pixel electrode A is expressed as Cs, the effective capacitance of a LCD cell is expressed as Clc, the capacitance of the parasitic capacitors between the gate/drain, the source/drain and the gate/source of the transistor are expressed as Cgd, Csd and Cgs, respectively.

As shown in FIG. 2, while the reference voltage Vt is kept at constant and the video signal Vsig is symmetrically varied around a dc voltage of Vsc, the voltage of the pixel electrode will get a shift voltage of $-\Delta Vp$ when the gate controlling signal Vg(N) is changing from a high voltage Vgh to a low voltage Vgl. This is induced by "feed through" effect. Therefore the shift voltage of $-\Delta Vp$ can be derived from the consistence of charge and the expressed equation is $$\Delta Vp=Cgd/Ct\times Vg$$

Wherein Vg=Vgh−Vgl (as shown on FIG. 8) is the gate pulse height of the gate controlling signal Vg(N), and $C_t$ is a totally effective capacitance at the pixel electrode. Thus, $C_t$ is the summation of the parasitic capacitor Cgd, the storage capacitor Cs and the effective capacitance of a LCD cell Clc.

Figure 7A:
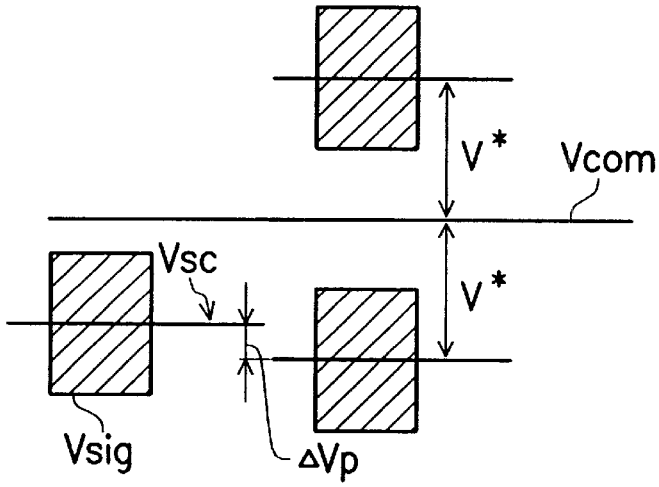
FIG. 7A is an indicative diagram of voltage ranges for a negative polarity and a positive polarity according to the present invention.
Figure 7B:
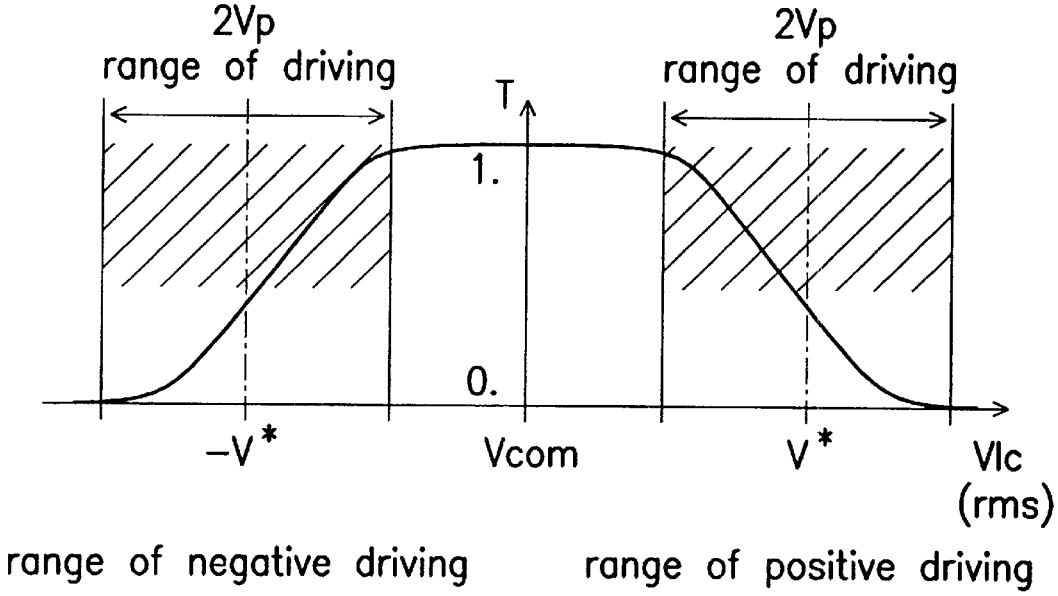
FIG. 7B is an diagram of the relationship for the normalized transparency and the voltage on an LCD cell (Vcl)

Therefore, by utilizing the "feed through" effect (the voltage of the pixel electrode A will get a shift voltage of $-\Delta Vp$ when the gate controlling signal Vg(N) is changing from Vgh to Vgl), the present invention adjusts the dc voltage Vsc of the video signal Vsig to the level of $-V^*+\Delta Vp$ before applying onto the source, as shown in FIG. 7A. Thus the voltage of the pixel electrode A needed for driving the LCD cell at negative polarity can be restored to its normal operating range by the "feed through" effect. In this example, as shown in FIG. 7B, $V^*$ is the central voltage in the curve of the normalized transparency to the voltage on a LCD cell (Vlc). The LCD cell is driven within the voltage range of $V^*\pm Vp$ or $-V^*\pm Vp$. Thus the present invention sets the dc voltage Vsc of the video signal Vsig equal to the level of $-V^*+\Delta Vp$ to compensate the $-\Delta Vp$ influence induced by "feed through" effect.

Furthermore, if the dc voltage Vsc of the video signal Vsig is shifted to $-V^*+\Delta Vp$, the voltage variation of the pixel electrode A can be shifted to the voltage range of positive polarity ($V^*\pm Vp$) by a similar coupling effect. This effect is induced by the rising edge of the gate controlling signal Vg(N−1) applied on the first scanning channel (i.e. the preceding scanning channel) right before the positive polarity video signal Vsig applying on the source (Vsig changed from negative to positive).

To sum up: because the dc voltage Vsc of the video signal Vsig has already been biased at $-V^*+\Delta Vp$, then (1) during a negative polarity period (odd field), the voltage variation of the pixel electrode will be shifted by the coupling effect of falling edge of Vg(N) to fit into the voltage range of $-V^*\pm Vp$; (2) during a positive polarity period (even field), the voltage variation of the pixel electrode will be shifted by the coupling effect of rising edge of Vg(N−1) to fit into the voltage range of $V^*\pm Vp$.

Figure 1:
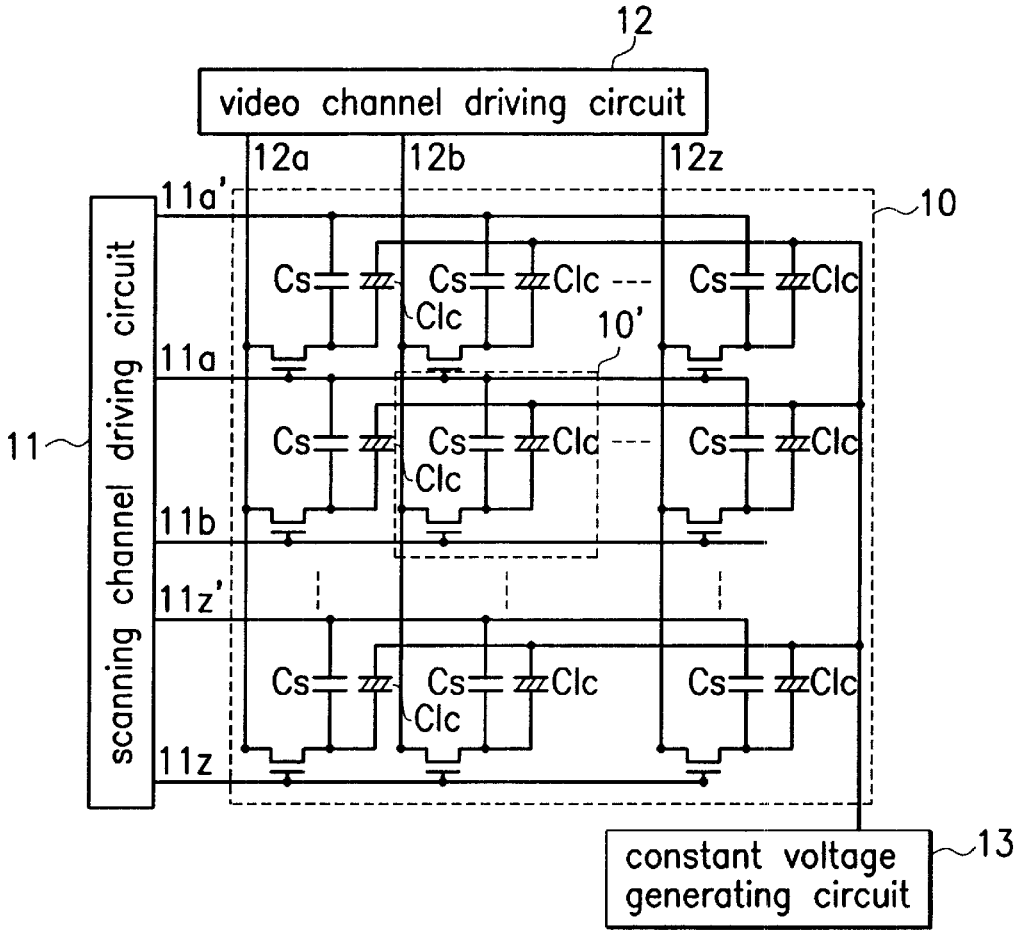
FIG. 1 is a driving circuit with a TFT active matrix according to the prior art.
Figure 8A:
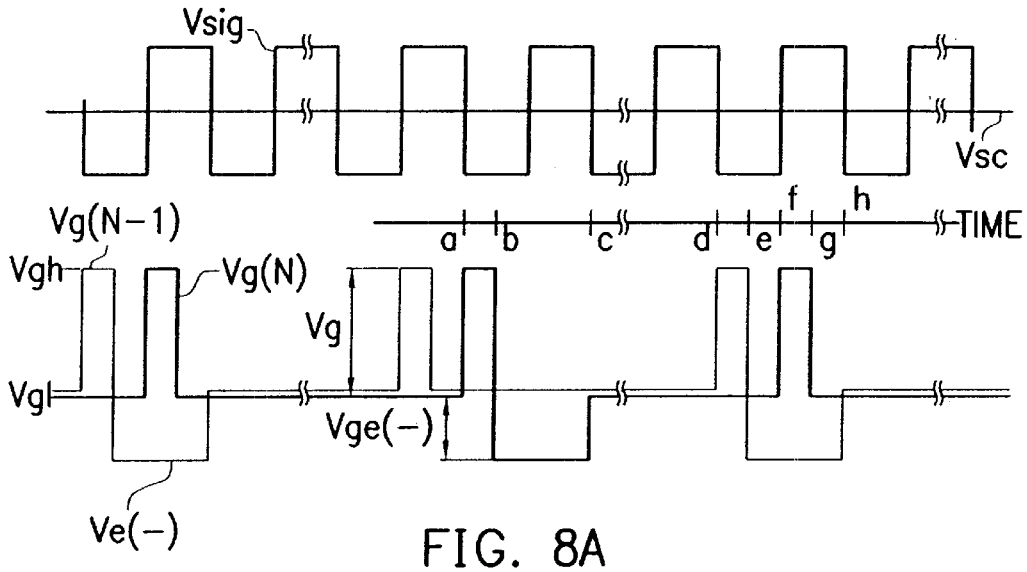
FIG. 8A is a diagram of the control signals applied in the circuit of FIG. 1 according to the present invention.
Figure 8B:
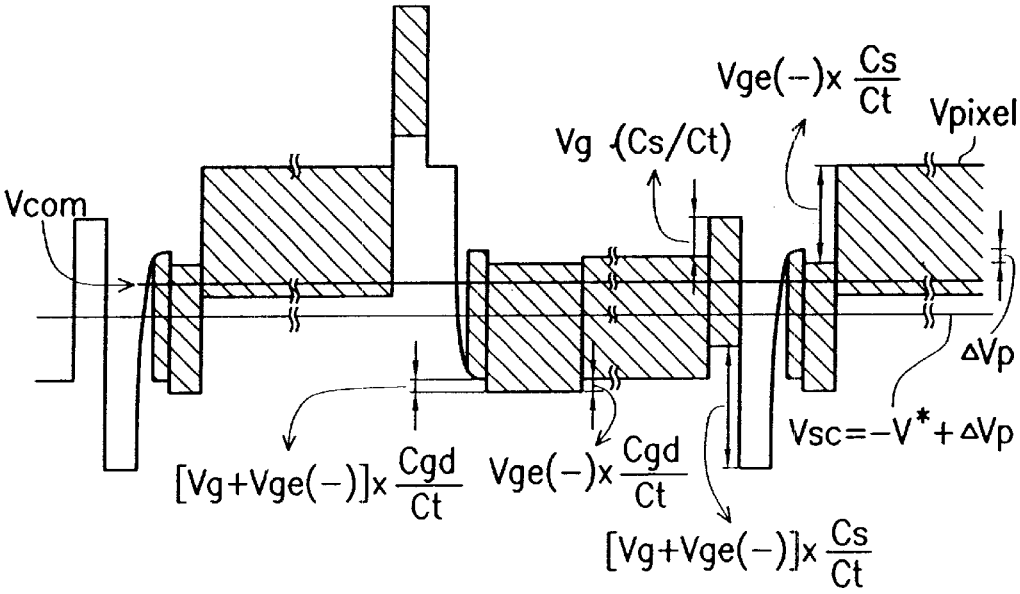
FIG. 8B is a diagram of the voltage at the pixel electrode A when applying the control signals of FIG. 8A.

FIG. 8A is a diagram of the control signals applied in the circuit of FIG. 1 according to the present invention. FIG. 8B is a diagram of the voltage at the pixel electrode A when applying the control signals of FIG. 8A.

While the driving circuit is operated at odd field, or the LCD cell is driven at negative polarity, the gate controlling signal Vg(N) is changed from a low voltage Vgl to a high voltage Vgh (at time a) and is held for a time period of $\tau 1$ (until time b) after the polarity of the video signal Vsig is changed from positive to negative. In is the meantime (time a to time b), the TFT transistor is turned on and the voltage of the pixel electrode A charged to the level of the negative polarity video signal Vsig. It is noted that the dc voltage Vsc of the video signal Vsig is set at the level of $-V^*+\Delta Vp$. Then, at time b, the gate controlling signal Vg(N) is lowered from Vgh to the negative gate expiatory voltage Vge(−) and is held for a time period of $\tau 2$. Then the voltage of the gate controlling signal Vg(N) comes back to the low voltage Vgl at time c. Thus the overall net voltage difference at the gate during the TFT transistor turn off process is −Vg, thus the coupling voltage at the pixel electrode A induced by the parasitic capacitor Cgd is $-Vg\times Cgd/Ct=-\Delta Vp$. Because the DC portion of the video signal Vsig has already been biased at $-V^*+\Delta Vp$ in advance; from time c to time d, the voltage of the pixel electrode A will be shifted to operate within the range of $-V^*\pm Vp$, as the requirement for the driving operation of negative polarity.

While the driving circuit is operated at even field, or the LCD cell is driven at positive polarity, the gate controlling signal Vg(N−1) at the first scanning channel (i.e. the preceding scanning channel) will be raised to the high voltage Vgh at time d and held for a period. At time e, the gate voltage Vg(N−1) will be reduced to a negative gate expiatory voltage $V_{ge}(-)$ and is held for a period of time $\tau 2$. While the gate controlling signal Vg(N−1) at the first scanning channel (i.e. the preceding scanning channel) is held at the voltage of $V_{ge}(-)$, the gate controlling signal Vg(N) goes to the high voltage Vgh to turn-on the TFT and is held for a period of time $\tau 1$ (from time f to time g). In the meantime, the voltage of the pixel electrode A is charged to the level of the video signal Vsig which has a dc voltage of $-V^*+\Delta Vp$. This means the dc voltage of the pixel electrode A is $-V^*+\Delta Vp$. When the gate controlling voltage Vg(N) is changed from the high voltage Vgh to the low voltage Vgl(at time g), a coupling voltage $-\Delta Vp=Vg\times Cgd/Ct$ induced by "feed through effect" is added at the pixel electrode. Thus the dc voltage of the pixel electrode A is $-V^*$ for now. When the gate controlling signal Vg(N−1) at the first scanning channel (i.e. the preceding scanning channel) returns to the low voltage Vgl from the negative gate expiatory voltage $V_{ge}(-)$ (at time h), a coupling voltage $V_{ge}(-)\times Cs/Ct$ induced by the "feed through effect" of the storage capacitor is added at the pixel electrode A. If $V_{ge}(-)\times Cs/Ct$ is set to be the value of $2\times V^*$, then the dc voltage of the pixel electrode A will be $V^*$. Thus the voltage variation of the pixel electrode A will be shifted to operate within the range of $V^*\pm Vp$, as the requirement for the driving operation of positive polarity shown in FIG. 7A.

The LCD will be repeatedly driven at odd field and at the even field as mentioned in the previous paragraphs.

The waveforms of the gate controlling signal Vg(N), Vg(N−1) . . . according to the present invention are shown in FIG. 8. The negative gate expiatory voltage $V_{ge}(-)$ will appear in one of the fields. Further, in order to accurately make the pixel electrode operate in the range of $V^*\pm Vp$, the negative gate expiatory voltage $V_{ge}(-)$ should satisfy the equation of $V_{ge}(-)\times Cs/Ct=2\times V^*$. Given the effective capacitor of a LCD cell is 0.2 pF, the capacitance of the storage capacitor is 0.6 pF, the parasitic capacitance Cgd is 0.05 pF, and the central voltage $V^*$ for driving is 3 V, then the absolute value of the negative gate expiatory voltage $V_{ge}(-)$ is $$[(0.6)/(0.2+0.6+0.05)]_{-1}\times 2\times 3=8.5 \text{ volt}$$

To Sum up, the method of the present invention comprises the steps of:

(1) transmitting the video signal Vsig to the pixel electrode A during an on-period of the switching transistor in response to the scanning signal Vg(N) applied to the second scanning channel (i.e. the current scanning channel) connecting the gate of the switching transistor, (time a to time b for negative polarity, or time f to time g for positive polarity.)

(2) applying the constant voltage Vt to bias the opposing electrode, and (3) applying the modulating signal to the first scanning channel (i.e. preceding scanning channel) with its voltage level falling and rising for Vge(−) once during an off-period of the switching transistor, but only the rising edge presented during the positive polarity of second scanning channel (i.e. the current scanning channel), (time h).

Driven by above signals, the operation of the present invention will be:

(a) during the negative polarity, a first negative potential change $-(Vg\times C_{gd}/C_t)$of the pixel electrode A caused by the voltage change Vg of the scanning signal Vg(N) through the parasitic capacitance between the gate and the drain of the switching transistor is superposed on the video signal voltage Vsig stored on the pixel electrode A.

(b) during the positive polarity, a positive potential change $Vge(-)\times C_s/C_t$ presented at the pixel electrode A caused by the rising voltage changes Vge(−) of the first scanning signal (i.e. the preceding scanning signal) Vg(N−1) through the storage capacitor and the negative potential change $-(V_g\times C_{gd}/C_t)$ of the pixel electrode A caused by the voltage change Vg of the second scanning signal (i.e. the current scanning signal) Vg(N) both are superposed on the video signal voltage Vsig stored on the pixel electrode A.

There are at least two ways to achieve the driving method according to the present invention:

(1) only the negative gate expiatory voltage $V_{ge}(-)$ need to be modified to satisfy the equation of $V_{ge}(-)\times Cs/Ct=2\times V^*$. In the meantime, there is no need to adjust the parasitic capacitance $C_{gd}$ and the dc voltage Vsc of the video signal Vsig is still set at $-V^*+\Delta Vp$.

(2) One can modify the capacitance of the parasitic capacitor Cgd and the storage capacitor Cs and the negative gate expiatory voltage $V_{ge}(-)$ to satisfy the equation of $V_{ge}(-)\times Cs/Ct=2\times V^*$. But the dc voltage Vsc of the video signal Vsig must also satisfy the value of $-V^*+\Delta Vp$. Thus the negative gate expiatory voltage $V_{ge}(-)$ and the dc voltage Vsc of the video signal Vsig need to simultaneously satisfy these two equations:

$$V_{ge}(-)\times Cs/Ct=2\times V^*,$$

and $$\Delta Vp=Cgd/Ct\times Vg.$$

Further, the timing of the waveforms should be noted while applying the present invention. If the LCD is operated at positive polarity for N scanning channel, the gate controlling signal Vg(N−1) must have the negative gate expiatory voltage $V_{ge}(-)$. But if the LCD is operated at negative polarity for N scanning channel, the negative gate expiatory voltage $V_{ge}(-)$ is unnecessary for Vg(N−1) gate controlling signal.

According to the description above, the driving method according to the present invention shifts the video signal to have a dc voltage of a first predetermined voltage. The driving method also adds a second predetermined voltage to the pixel electrode after the second scanning signal changes the state of the switching transistor from turned-on to turn-off. Thus, while the LCD cell is driven at negative polarity, the voltage of the pixel electrode A will automatically fit to the range of $(-V^*\pm Vp)$ via the coupling of the parasitic capacitor Cgd. While the LCD cell is driven at positive polarity, the voltage of the pixel electrode A will automatically fit to the range of $(V^*\pm Vp)$ via the coupling of the storage capacitor Cs. For example: (1) if we want to generate a $(-V^*-Vp)$ voltage at electrode A during the negative polarity period, then we should apply $Vsig=(-V^*-Vp+\Delta Vp)$, (2) if we want to generate a $(+V^*+Vp)$ voltage at electrode A during the positive polarity period, then we should apply $Vsig=(-V^*+Vp+\Delta Vp)$. Therefore, $Vsig=(-V^*-Vp+\Delta Vp)$ during negative polarity period and $Vsig=(-V^*+Vp+\Delta Vp)$ during positive polarity period will keep the LCD cell driven in same transparency as shown in FIG. 7B.

Therefor, the driving method according to the present invention has the advantages (1) simplifying waveforms of the gate controlling signals from four different levels to only three different levels, and (2) reducing the necessary output voltage variation range of the video signal Vsig from prior art $2V^*+2Vp$ to current invention 2Vp.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A driving method for a liquid crystal display (LCD), the LCD being driven by a plurality of switching transistors positioned in a matrix, each switching transistor comprising a drain, a gate and a source, the drain of each switching transistor coupling to a first scanning signal via a storage capacitor and coupling to a pixel electrode, the gate and the source of each switching transistor respectively coupling to a second scanning signal and a video signal, the driving method comprising the following step:

shifting the video signal to have a dc voltage of a first predetermined voltage after the second scanning signal changes the state of the switching transistor from turned-on to turned-off, thereby adding a second voltage to the pixel electrode through the coupling effect of the storage capacitor and parasitic capacitors.

2. The driving method of claim 1, wherein the switching transistors are thin-film-transistors (TFT).

3. The driving method of claim 2, wherein the second predetermined voltage is equal to $$V_{ge}(-)\times C_s/C_t=2\times V^*,$$

wherein $V_{ge}(-)$ is a negative gate expiatory voltage, $C_s$ is the capacitance of the storage capacitor, $C_t$ is a totally effective capacitance at the pixel electrode, and $V^*$ is the central driving voltage of the LCD.

4. The driving method of claim 2, wherein the second predetermined voltage, the capacitance of the storage capacitor Cs and a gate-to-drain parasitic capacitance $C_{gd}$ formed between the gate and the drain of each TFT simultaneously satisfy the following equations:

$$V_{ge}(-)\times C_s/C_t=2\times V^*,$$

and $$\Delta V_p=V_g\times C_{gd}/C_t,$$

wherein $V_{ge}(-)$ is a negative gate expiatory voltage, $C_S$ is the capacitance of the storage capacitor, $C_t$ comprising $C_{gd}$ is a totally effective capacitance at the pixel electrode, $V^*$ is the central driving voltage of the LCD, and Vg is the gate pulse height of the second scanning signals, and wherein a DC voltage $V_{sc}$ of the video signal is equal to $-V^*+\Delta V_p$.

5. The driving method of claim 2, wherein the first predetermined voltage is equal to $$-V+[C_{gd}/C_t]\times V_g,$$

wherein $V^*$ is the central driving voltage of the LCD, $C_{gd}$ is a gate-to-drain parasitic capacitance formed between the gate and the drain of each TFT, $C_t$ comprising $C_{gd}$ is a totally effective capacitance at the pixel electrode and Vg is the gate pulse height of the second scanning signals.

6. A driving method for a liquid crystal display (LCD), the LCD being driven by a plurality of switching transistors positioned in a matrix, each switching transistor comprising a drain, a gate and a source, the drain of each switching transistor coupling to a first scanning signal via a storage capacitor and coupling to a pixel electrode, the gate and the source of each switching transistor respectively coupling to a second scanning signal and a video signal, the driving method comprising the following step:

shifting the video signal to have a dc voltage of a first predetermined voltage after the second scanning signal changes the state of the switching transistor from turned-on to turned-off, thereby adding a second voltage to the pixel electrode through the coupling effect of the storage capacitor and parasitic capacitors, wherein the first predetermined voltage is equal to $$-V^*+(C_{gd}/C_t)\times V_g,$$

wherein $V^*$ is the central driving voltage of the LCD, $C_{gd}$ is a gate-to-drain parasitic capacitance formed between the gate and drain of each TFT, $C_t$ comprising $C_{gd}$ is a totally effective capacitance at the pixel electrode and $V_g$ is the gate pulse height of the second scanning signals.

7. The driving method of claim 6, wherein the switching transistors are thin-film-transistors (TFT).

8. The driving method of claim 6, wherein the second predetermined voltage is equal to $$V_{ge}(-)\times C_s/C_t=2\times V^*,$$

wherein $V_{ge}(-)$ is a negative gate expiatory voltage, $C_s$ is the capacitance of the storage capacitor, ct is a totally effective capacitance at the pixel electrode, and V* is the central driving voltage of the LCD.

9. The driving method of claim 6, wherein the second predetermined, voltage, the capacitance of the storage capacitor $C_s$ and a gate-to-drain parasitic capacitance $C_{gd}$ formed between the gate and the drain of each TFT simultaneously satisfy the following equations:

$$V_{ge}(-)\times C_s/C_t=2\times V^*,$$

and $$\Delta Vp=V_g\times C_{gd}/C_t,$$

wherein $V_{ge}(-)$ is a negative gate expiatory voltage, $C_s$ is the capacitance of the storage capacitor, $C_t$, comprising $C_{gd}$ is a totally effective capacitance at the pixel electrode, V* is the central driving voltage of the LCD, and $V_g$ is the gate pulse height of the second scanning signals, and wherein a DC voltage Vsc of the video signal is substantially equal to $-V^*+\Delta Vp$.

10. The driving method of claim 1, wherein the second predetermined voltage is added to the pixel electrode through the coupling effect of the storage capacitor and parasitic capacitors to compensate a voltage induced by a feed through effect occurring at a moment when the second scanning signal vanishes, and to keep the voltage of the pixel electrode in a desired voltage range.

* * * * *